US005377778A

United States Patent [19]

Lan

[11] Patent Number: 5,377,778

[45] Date of Patent: Jan. 3, 1995

[54] EMERGENCY FIRE ESCAPE FOR MULTI-STORIED BUILDING

[76] Inventor: Tung-Hai Lan, No. 18, Lane 256, Section 3, Chung Shing Rd., Syh Jye Tsuen, Wu Jye Hsiang, Ilan Hsien, Taiwan, Prov. of China

[21] Appl. No.: 124,631

[22] Filed: Sep. 22, 1993

[51] Int. Cl.[6] ..... A62B 1/20

[52] U.S. Cl. ..... 182/48; 182/100; 182/82

[58] Field of Search ..... 182/48, 49, 100, 82

[56] References Cited

U.S. PATENT DOCUMENTS

| | | | |
|---|---|---|---|
| 362,448 | 5/1887 | Jones | 182/100 |
| 740,917 | 10/1903 | Prouty | 182/49 X |
| 3,754,621 | 8/1973 | Liou | 182/49 |
| 4,244,443 | 1/1981 | Naka | 182/100 |

*Primary Examiner*—Alvin C. Chin-Shue
*Attorney, Agent, or Firm*—Bacon & Thomas

[57] ABSTRACT

An emergency corridor and ladder for multi-storied building comprising a bridge corridor, a safety ladder and a temporary emergency shelter. The structure is provided in each floor of the multi-storied building. The bridge corridor is connected to the emergency exit on each floor, both sides of the bridge corridor are respectively provided with a fire-blocking wall, and a safety ladder is provided along the bridge corridor such that the safety ladder are connected together from the top floor to the ground level. Said safety ladder has a passage to the sun deck of the emergency shelter. A feed through emergency escape rod is provided in the emergency shelter in which a man hole is opened in alternate floors. Rescuers gain access to the emergency shelter and rescue the casualty during an emergency. The man hole can also be used to cooperate with the emergency escape rod so that people can slide down to the ground level. In addition, an intermediate wall is provided for an upper an a lower safety ladder. An automatic sprinkler system can be provided on the intermediate wall. Moreover, the bridge corridor and the bottom of the safety ladder are also provided with a plurality of automatic sprinklers such that the sprinkler turns on when a fire breaks out and all personnel can pass through the bridge corridor safely to enter into the emergency shelter.

7 Claims, 7 Drawing Sheets

EMERGENCY FIRE ESCAPE FOR MULTI-STORIED BUILDING

BACKGROUND OF THE INVENTION

1. Field of the Invention

The present invention relates to an emergency fire escape for a multi-storied building, and more particularly to a structure which consists of a bridge corridor, a safety ladder and an emergency shelter. When a fire breaks out in the multi-storied building, the personnel in the building can exit from the emergency exit, pass through the bridge corridor, the safety ladder to reach the emergency shelter where they can wait to be rescued or escape by themselves.

2. Description of the Prior Art

When a fire breaks out in a multi-storied building, it is not easy to escape or to be rescued. The strong blaze and the heavy smoke combine to make it difficult and dangerous to flee the building. This is especially true for elderly, women and children when the disastrous incident happens. Although emergency exits are usually provided, it is still not possible to escape the main building on fire in a short period of time. Moreover, the emergency exits are sometimes blocked out by storage materials, and no emergency shelter is provided in the building. Because the escape routes are often obstructed and no shelter is provided for temporary occupancy, people are sometimes forced to jump out from the window. This increase the number of victims of a disastrous event.

SUMMARY OF THE INVENTION

The main object according to the present invention is to provide an emergency fire escape for escaping from a multi-storied building. It mainly consists of a bridge corridor, a safety ladder and an emergency shelter or an emergency sun deck, which can be effectively insulated from the main building. Fire hydrants and automatic sprinkler systems are also provided for protection. When a disastrous event, particularly a fire, happens, the bridge corridor and the safety ladder provide a passage for the personnel reach to emergency shelter, from which they can escape or wait for help. The emergency shelter provides a safe place for the elderly, women and children to stay. The casualties can therefore be minimized.

Another object according to the present invention is to provide an emergency corridor and ladder for escaping from a multi-storied building in which a fire-blocking wall is provided on both sides of the bridge corridor. The fire-blocking wall is built up by firebricks and provides an insulation so that the rescue team can pass through the corridor without any safety concern.

A further object according to the present invention is to provide an emergency corridor and ladder for escaping from a multi-storied building in which the emergency shelter is provided with offset man holes on alternate floors. The man holes have emergency escape rode to feed through so that the personnel can slide down from any floor to the ground level.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
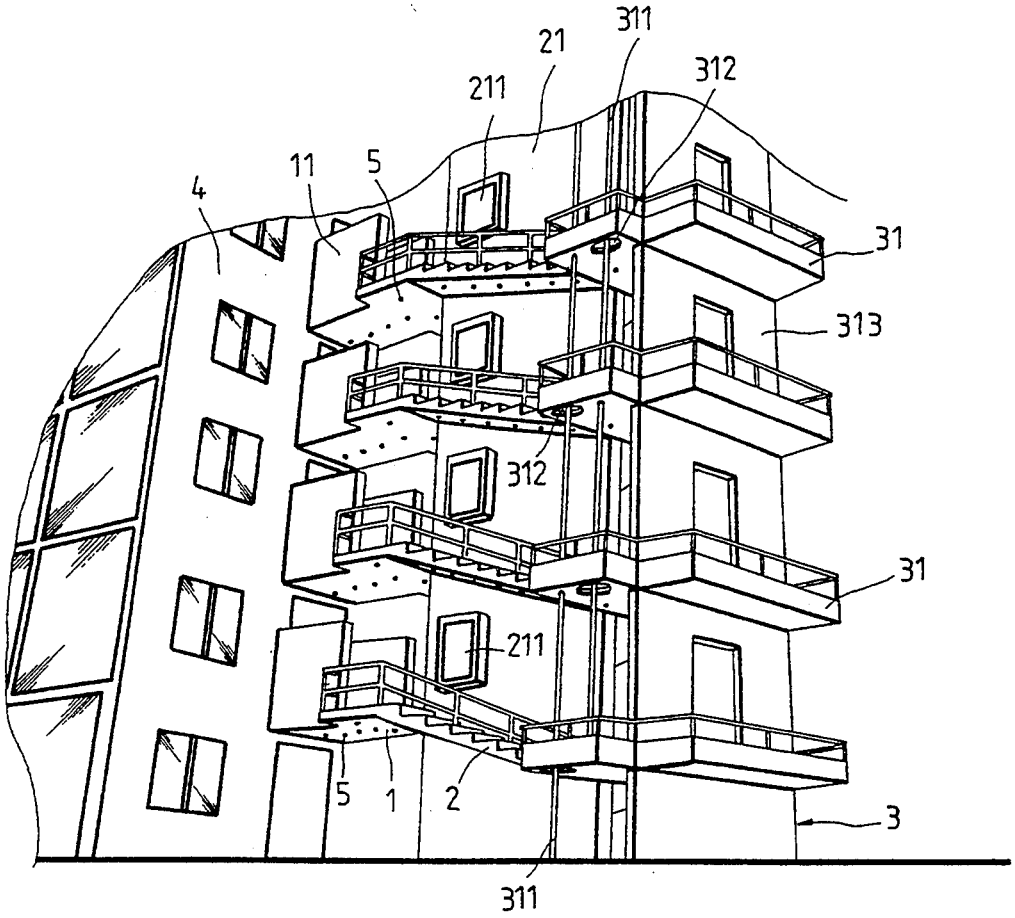
FIG. 1 is a perspective view showing the emergency bridge corridor and the ladder attached to the main building according to the present invention.
Figure 2:
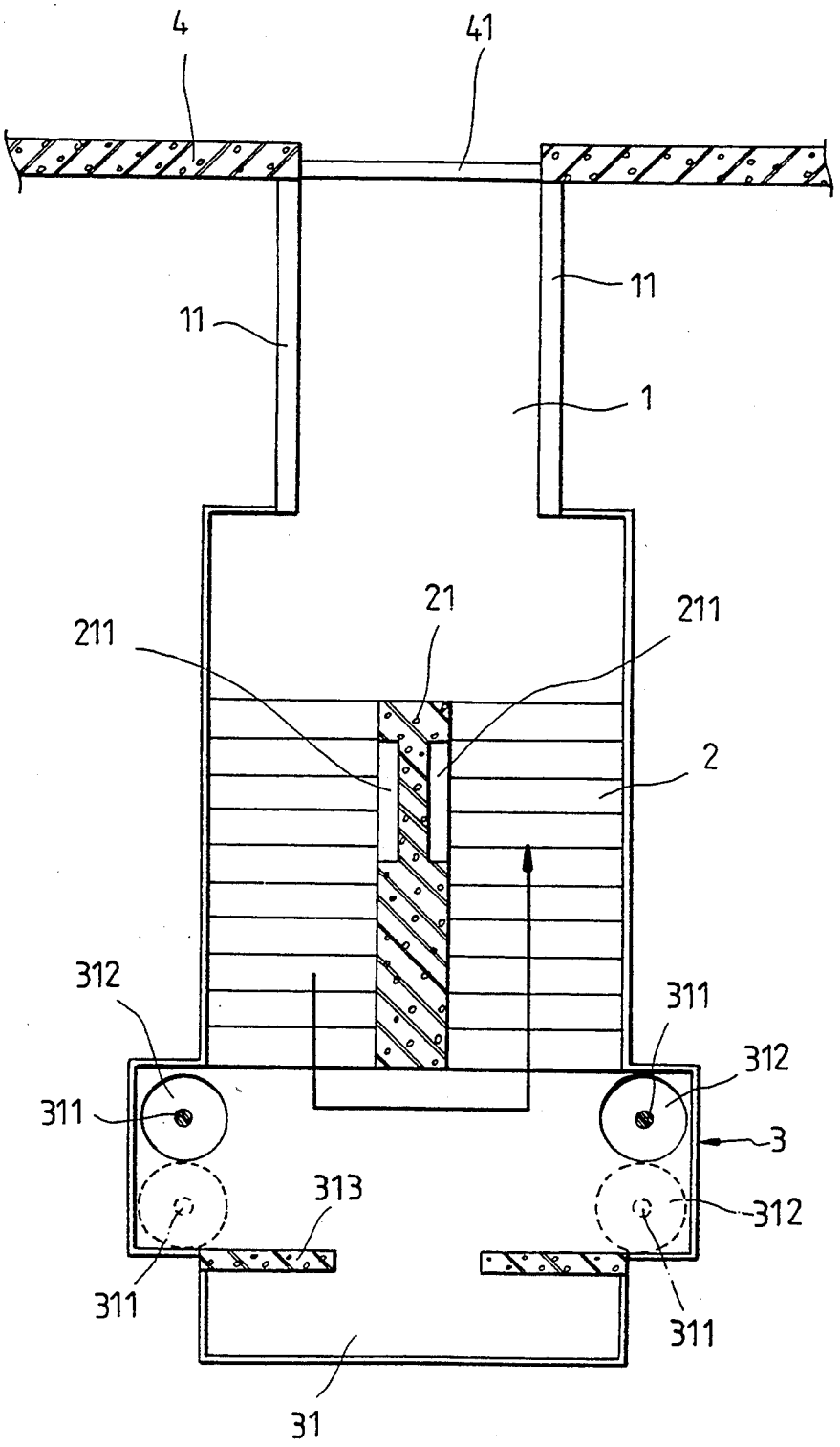
FIG. 2 is a cross-sectional view of the bridge corridor, the emergency ladder, and the emergency shelter with its associated man holes according to the present invention.
Figure 3:
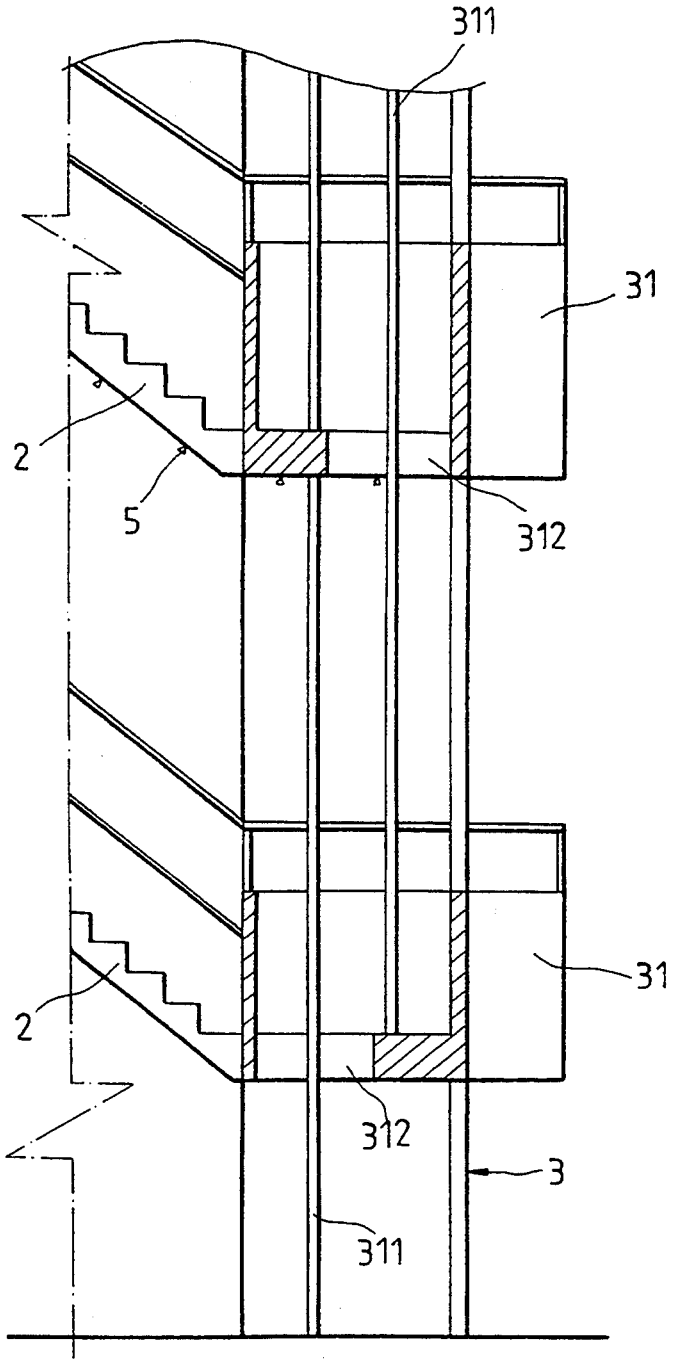
FIG. 3 is a cross-sectional side view of the emergency shelter attached to the main building according to the present invention.
Figure 4:
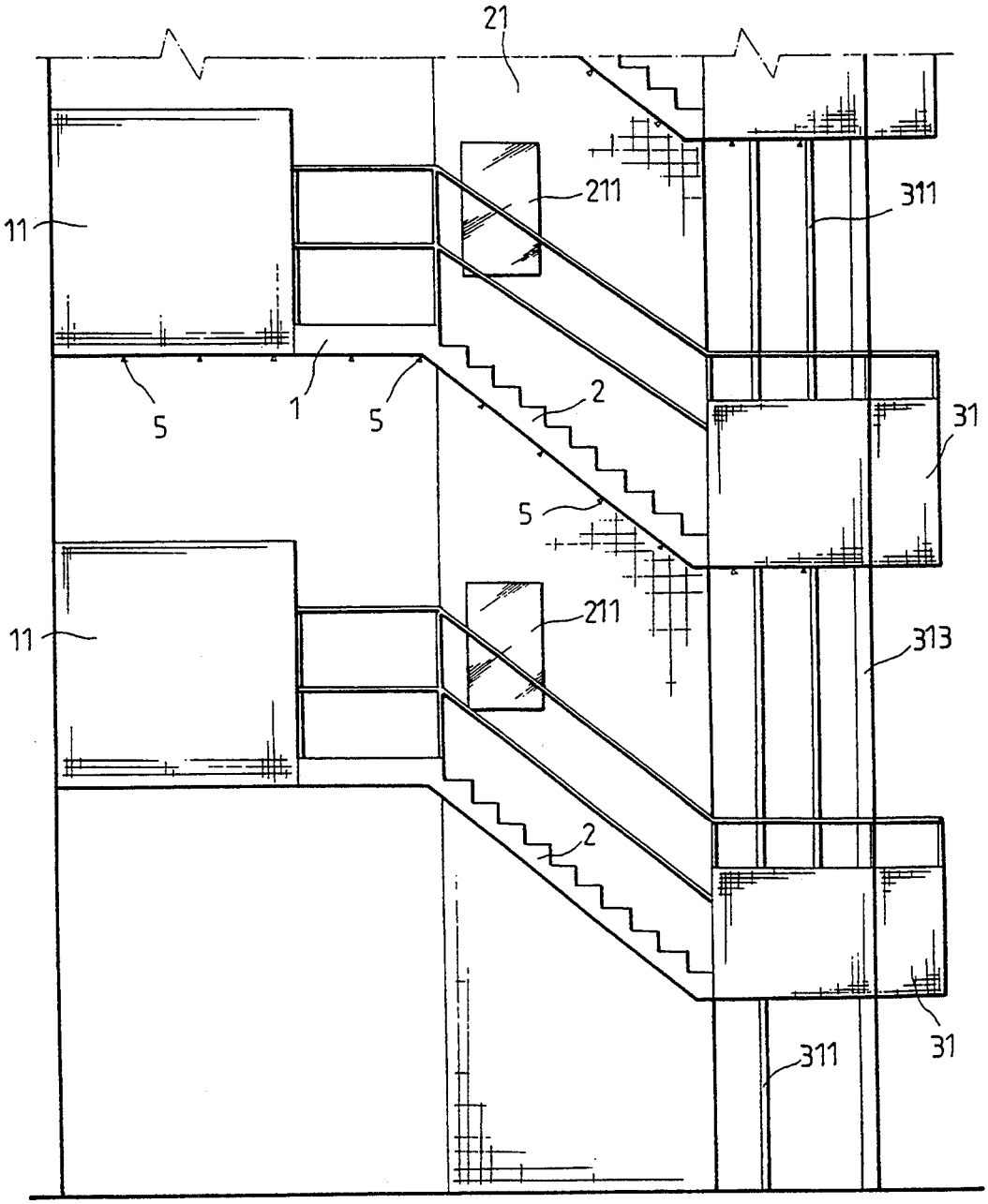
FIG. 4 is a cross-sectional side view of the entire structure according to the present invention.

As noted in FIGS. 1 and 2, the present invention mainly consists of a bridge corridor 1, a safety ladder 2 and an emergency shelter 3. The structure is attached to a multi-storied main building 4 in which the bridge corridor 1 is provided at the emergency exit 41 on each floor of the main building 4 to form a passage. Both sides of the passage are provided with fire-blocking walls 11 which are built up with firebricks. The fire-blocking walls 11 have an appropriate height to effectively block out the fire and the heavy smoke from entering into the bridge corridor 1. The safety ladder 2 is provided to cooperate and connect with the bridge corridor 1 on each floor so that it extends all the way to the ground. The safety ladder 2 is not restricted in its shape as long as it is connected to the bridge corridor 1 on each floor and runs all the way down to the ground. The emergency shelter 3 is provided outwardly of the safety ladder 2 and at an appropriate distance from the main building 4. A plurality of sun decks 31 are provided for the emergency shelter 3. Each of the sun decks 31 communicates directly with the ladder 2 at each floor level of the main building 4. An emergency escape rod 311 is provided in an appropriate location of the sun deck 31, characterized in that the emergency escape rod 311 is connected to each of the sun deck 31 from the top to the bottom. A man hole 312 is opened in each of the sun decks 31 and affect for each other on adjacent floors of the emergency shelter. The emergency escape rod 311 feeds through each man hole 312 and provides an alternate passage for the people to slide down quickly to ground level. The basic passage for exit is the safety ladder 2 in which people can step down from one floor to a lower one to get to the ground level for assistance.

Each of the intermediate walls 21 associated with upper and lower portions of ladder 2 is provided with a fire hydrant 211 or other fire extinguisher so that it is readily available when needed. This mobilization of fire extinguishing can minimize the damage during the disaster. Moreover, the bridge corridor 1 and the bottom of the safety ladder 2 are provided with a plurality of automatic water sprinkler's 5, which are turned on when hot temperature is sensed due to the break out of a fire. The sprinkler system assures that the rescuers can pass through the bridge corridor and the safety ladder safely to the emergency shelter, or the rescuer can slide down through the emergency escape rod.

Figure 5:
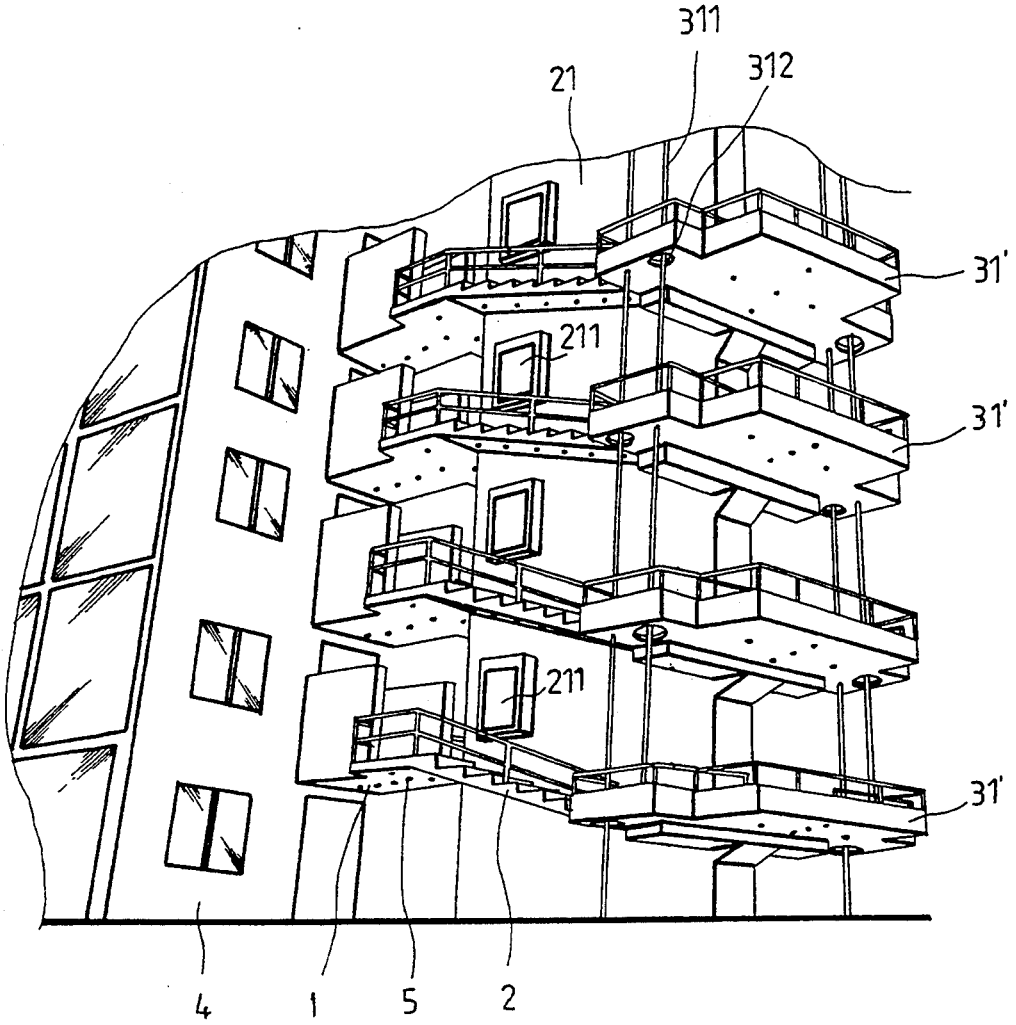
FIG. 5 is a perspective diagrammatic view of another embodiment according to the present invention.

Each of the sun decks 31 in the emergency shelter 3 can be provided with an appropriate block wall 313 which is built to block out the blaze, the heat and the heavy smoke completely. This block wall 313 assures that the sun deck 31 is a safety spot for the elderly, women, children and the handicap to stay. The sun deck 31 provides a safety spot so that the elderly and the children will not be pushed down and stepped on during an emergency. The rescuers can access the sun deck and guide them to a safe place one by one. In addition, as can be noted from FIG. 5, the structure according to the present invention can also be modified in which the intermediate wall 21 is provided with an emergency exit sun deck 31' extending directly therefrom. The sun deck 31' forms a platform at the area where the safety ladder 2 from one floor turns and proceeds to the next lower floor and has an appropriate guard rail to surround it for safety. By such design, the emergency sun deck 31' extending from the intermediate wall 21 can be used as a temporary emergency shelter. It can also be provided with man holes having emergency escape rod 311 to feed through. This is just another embodiment and is not being described here.

Figure 6:
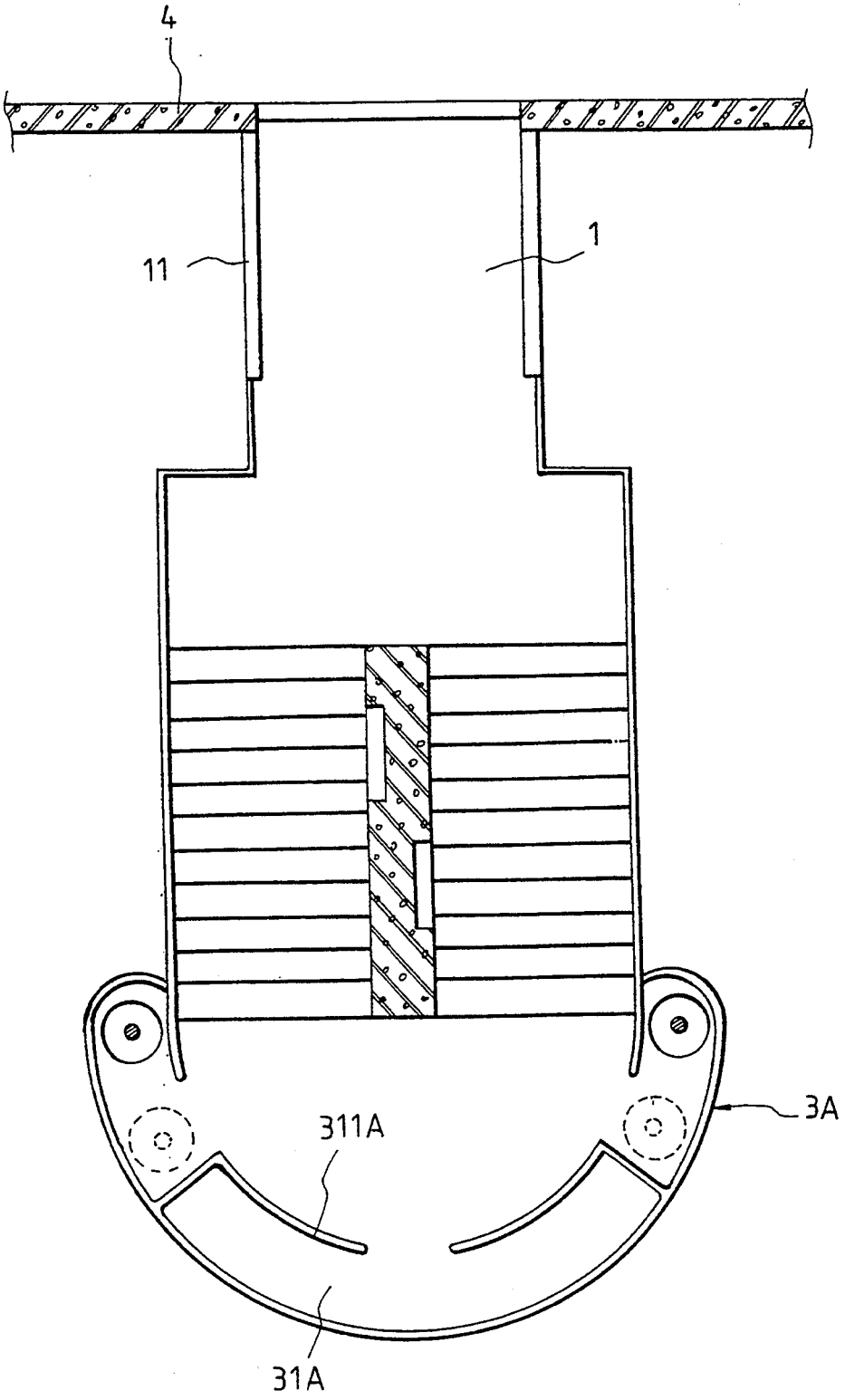
FIG. 6 is a cross-sectional view of another embodiment of the emergency shelter with an arc shape according to the present invention.
Figure 7:
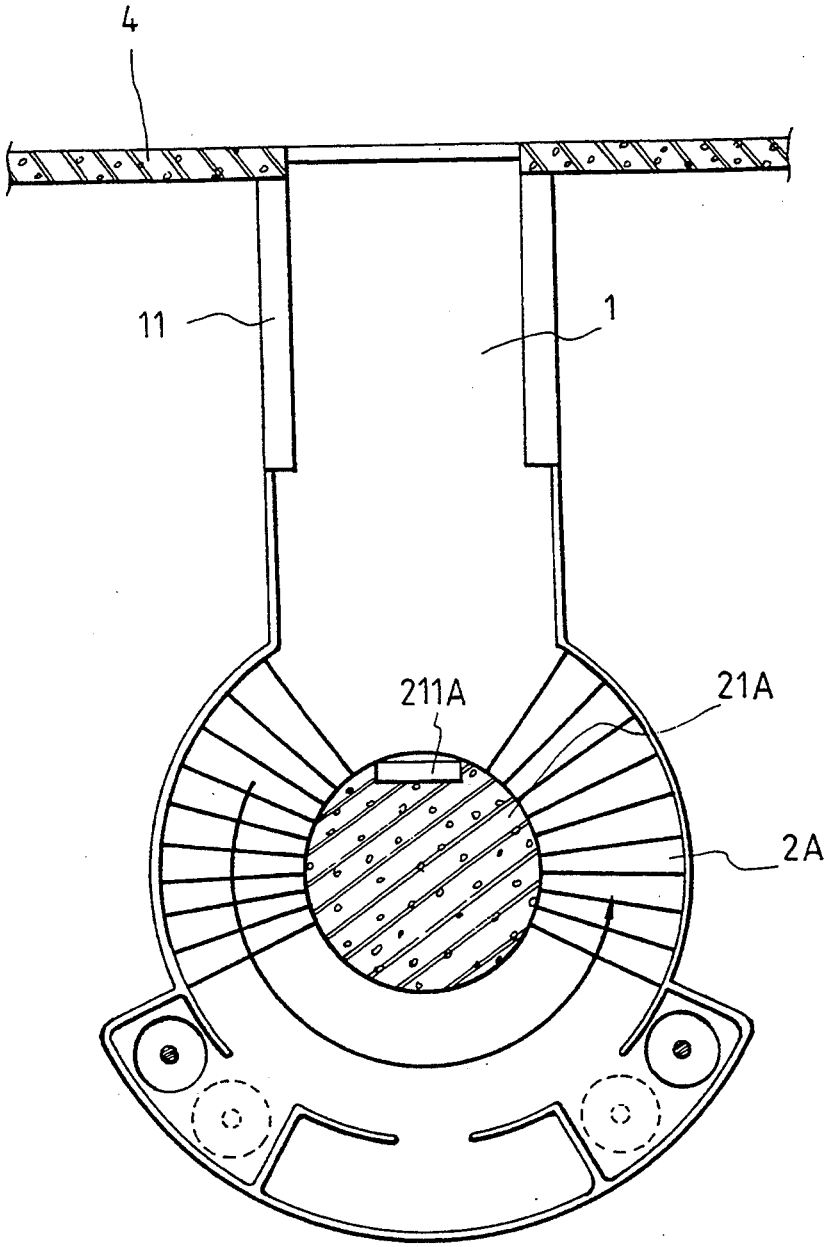
FIG. 7 is a cross-sectional view of another embodiment of the safety ladder built with a circular shape according to the present invention.

As shown in FIG. 6, the emergency shelter 3A can further be modified to have an appropriate shape of an arc. Its sun deck 31A and the block wall 313A also have the appropriate shapes arcuate. This embodiment of an arcuate structure gives an artistic effect. In addition, the safety ladder 2A can be a circular continuous type cooperating with a central column 21A. Fire extinguisher devices 211A are provided at selected positions along of the central column 21A. These simple modifications and variations from the preferred embodiment are possible. It is not intended to limit the invention to the precise form disclosed. It is therefore intended that the scope of the invention be limited not by this detailed description, but rather by the claims appended hereto.

What is claimed is:

1. An emergency escape for permitting occupants to quickly and safely escape from a multi-story building during an emergency comprising:

a) an exit formed through an exterior wall on each floor of a multi-storied building;

b) a safety ladder positioned exteriorly of the building and extending between the floors thereof for evacuating occupants from the building to ground level;

c) a bridge corridor extending outwardly from each exit for providing a passage between the exit and the safety ladder during evacuation;

d) an emergency shelter extending outwardly from the safety ladder at each floor level for use by the occupants during evacuation down the safety ladder; and e) each emergency shelter including a sundeck and at least one escape rod means extending through the sundecks to ground level for providing an alternate means of evacuation for the occupants.

2. The emergency escape of claim 1 wherein the escape rod means includes at least two rods and a manhole formed around one rod at each sundeck, with the manholes of adjacent sundecks being offset from each other.

3. The emergency escape of claim 1 further including:

a) an intermediate wall positioned between an upper portion and a lower portion of the safety ladder corresponding to each story of the building; and b) the sundeck extends outwardly from an end of the intermediate wall adjacent an area travelled by the occupants from the upper portion to the lower portion of the safety ladder during evacuation.

4. The emergency escape of claim 1 wherein the bridge corridor includes at least two spaced fire-blocking walls and the sundeck includes at least one fire blocking wall.

5. The emergency escape of claim 1 further including a plurality of fire extinguisher means.

6. The emergency escape of claim 1 wherein the safety ladder is of a circular configuration and includes a central column extending therethrough.

7. The emergency escape of claim 1 wherein the emergency shelter is of a substantially arc shape.

* * * * *